US005092127A

United States Patent [19]

Miller

[11] Patent Number: 5,092,127

[45] Date of Patent: Mar. 3, 1992

[54] STEAM POWERED VEHICLE

[76] Inventor: Sidney H. Miller, 850 E. Louther St., Carlisle, Pa. 17013

[21] Appl. No.: 573,740

[22] Filed: Aug. 28, 1990

[51] Int. Cl.[5] ..... F01K 15/00

[52] U.S. Cl. ..... 60/668; 60/670

[58] Field of Search ..... 60/660, 664, 665, 667, 60/668, 669, 670; 180/310, 302

[56] References Cited

U.S. PATENT DOCUMENTS 3,835,650 9/1974 Chesmejef ..... 60/670

3,906,731 9/1975 Carlson ..... 60/667 X 4,023,367 5/1977 Izumi ..... 60/670 X 4,064,699 12/1977 Martz ..... 60/667 X 4,290,269 9/1981 Hedström ..... 60/670

*Primary Examiner*—Allen M. Ostrager

[57] ABSTRACT

A power system for a wheeled vehicle in which the vehicle is powered from a steam power plant. The fuel is stored on the vehicle in the form of a compressed block of solid fuel. A fuel grinder or pulverizer is provided between the fuel storage and the steam generator to allow the solid fuel to be delivered in a particle form.

1 Claim, 1 Drawing Sheet

STEAM POWERED VEHICLE

FIELD OF THE INVENTION

This invention describes a system for utilizing solid fuel to power a mobile system, such as a car, truck, tractor and so forth.

BACKGROUND OF THE INVENTION

Solid fuels have been used in many stationary systems and also found uses in automobiles and trucks during times of national emergency. During World War II, the Japanese and Swedish, plus other countries, used a system whereby the fumes or vapors issuing from a burning solid were piped to a standard type engine in place of petroleum. These systems were satisfactory for emergency conditions but could not be used in present day systems because of their bulkiness and strict pollution control laws. In this system we plan to use a refined solid fuel that has much of the ash and sulphur removed for energy.

SUMMARY OF THE INVENTION

In this invention, a solid fuel is installed in the rear or front of the mobile system and hermetically sealed to prevent any solids from escaping into the atmosphere. The solid fuel in the form of a block or cube is suspended above a grinder which transfers the solid in a particle form, which can be educted, into a boiler. Within the boiler, an organic or inorganic liquid is boiled and vaporized. The resulting vapor from the boiler, is used to drive a turbine which is connected to a transmission for transfer of power to the wheels. The vapor from the turbine is condensed and reintroduced to the boiler with a pump(s). The gasses generated within the boiler pass to a catalytic converter, where any remaining particles are oxidized. The mixture of hot gasses and unoxidized dust pass to a collector for removal. The exiting hot gases are used to heat the incoming air which is used in an eductor to pick up the solid fuel. Additional energy is recovered from the exhaust gasses by passing them into another boiler which vaporizes an inorganic or organic liquid. The vapor from the boiler powers a turbine that is connected to a shaft which in turn is connected in one case to a propeller. This propeller is used to provide additional forward power. The power from the turbine, can also be picked up by a generator and this power converted into electricity, which then powers a motor that is linked to the wheels of a car or truck.

In another system the turbine shaft could be connected to the transmission for transferring the power to the wheels. The vapor from the turbine is liquefied in a condenser and forced into a boiler with a pump to repeat the cycle. The exhaust gasses with their reduced energy are then exhausted to the atmosphere.

DESCRIPTION OF THE INVENTION

Figure 1:
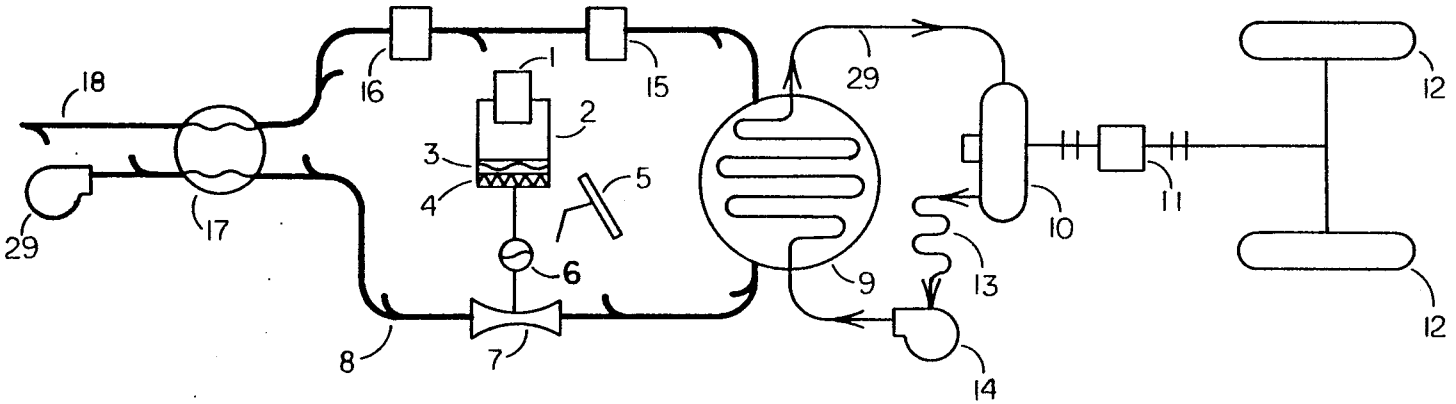
FIG. 1 is a drawing of the main system.
Figure 2:
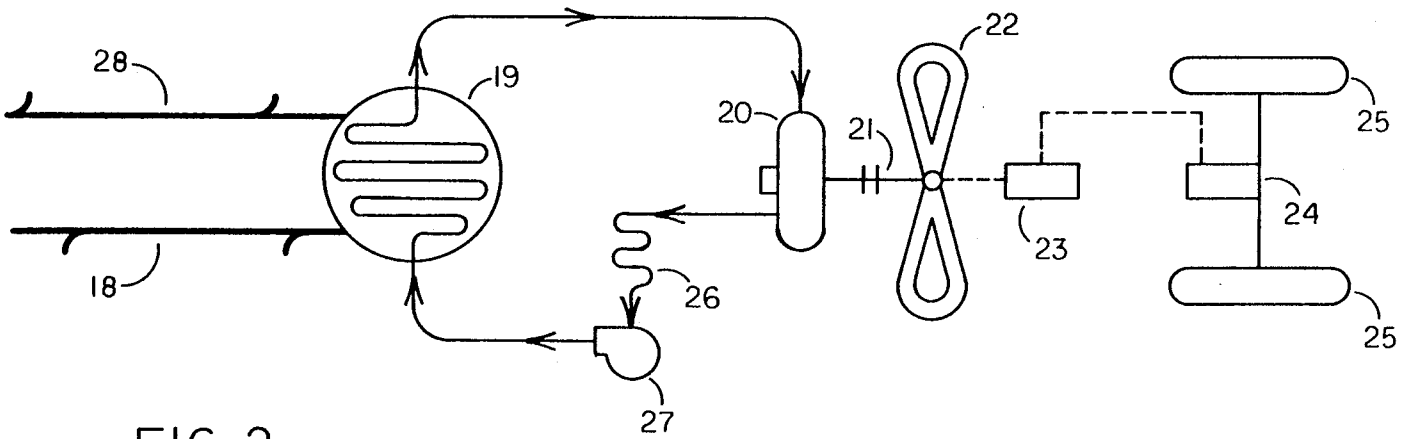
FIG. 2 is a drawing of the energy recovery system.

Solid fuel 1 which is derived from coal, hay, paper, wood, or other combustible matter, is introduced to the tank 2 of the car or truck either in the form of a solid compressed block 1 of one of the preceding materials or is conveyed into the tank 2, either pneumatically or mechanically. From the tank 2, the material passes to a grinder 3 and or a vibrator 4 which disperses the solid fuel and passes it through a valve and/or feeder 6 which is connected to an accelerator 5 that is located within the car or truck. By regulating the speed of the valve and/or feeder 6 and the grinder 3 and/or vibrator 4, it is possible to maintain a regulated flow of solid fuel particles. These solid fuel particles pass to the eductor 7 where a stream of air picks up the particles. The air is supplied by fan 29 and air passes through a heat exchanger 17 where it picks up exhaust heat. The air passes through line 8 and the educted air and solid mixture then passes to a boiler 9 where the combustion takes place and heat is generated to vaporize the liquid within the boiler 9. The exhaust hot gasses from the boiler 9 pass to a catalytic converter 15 where any of the fuel not burned by the boiler 9 is oxidized. Any dust remaining is picked up with dust collector 16 and the remaining hot gasses pass to heat exchanger 17 where the heat is picked up by the incoming air that is introduced with fan 29. The exhaust gasses 18 leave the heat exchanger and are either passed to the atmosphere or reintroduced into boiler 19 for more energy recovery. Now we will complete the vapor cycle from boiler 9. The superheated vapor issuing through line 29 from boiler 9 passes to a turbine 10 that is connected to a transmission 11, which transmits and regulates the power to the wheels 12 of the car or truck. The exhaust vapors issuing from turbine 10 are liquefied in condenser 13 and then reintroduced to the boiler 9 with the pump(s) 14 to repeat the cycle.

The exhaust 18 may have additional energy which can be recovered in boiler 19. In boiler 19 a liquid is boiled, vaporized and superheated and passed to a turbine 20. In turbine 20 the energy is transferred to a shaft 21 that is connected to a propeller 22, to give additional thrust to the automobile or truck system. In addition to connecting shaft 21 to the propeller it is also possible to connect shaft 21 to a generator which produces electricity which is then used to operate a motor 24 which is connected to the wheels 25. It is also possible to connect shaft 21 to a transmission and use this energy to operate the wheels 25 of the truck or car. The vapor from turbine 29 is liquified in condenser 26, and then passes to a pump 27 for reintroduction to the boiler 19 to repeat the cycle. The exhaust gasses from boiler 19 exit to the atmosphere or another recovery system.

I claim the following:

1. A steam-powered vehicle comprising:

a vehicular structure supported by a plurality wheels; the wheels being driven by a transmission which is powered by a steam power plant contained within the vehicle structure; said power plant including a prime mover which is driven by steam that is generated from an on-board steam generator, the improvement comprising:

a source of solid fuel in the form of a block housed within the vehicle;

means for grinding said fuel on-board the vehicle to transform the fuel into a particle form;

means for delivering the solid fuel to the grinding means;

means for delivering the fuel in its particle form from the grinding means to the steam generating means.

* * * * *